US005358117A

United States Patent [19]

Adams

[11] Patent Number: 5,358,117

[45] Date of Patent: Oct. 25, 1994

[54] MEDICINE CONTAINER CAP WITH TIME INDICATOR

[76] Inventor: James Adams, P.O. Box 2173, Aspen, Colo. 81612

[21] Appl. No.: 175,971

[22] Filed: Dec. 30, 1993

Related U.S. Application Data

[63] Continuation-in-part of Ser. No. 934,956, Aug. 25, 1992, Pat. No. 5,279,422.

[51] Int. Cl.[5] ..... B65D 83/04

[52] U.S. Cl. ..... 206/534; 116/308; 206/459.1; 215/230

[58] Field of Search ..... 206/534, 459.1, 459.5; 215/230; 116/308

[56] References Cited

U.S. PATENT DOCUMENTS

| | | | |
|---|---|---|---|
| 2,024,889 | 12/1935 | Simeone | 206/534 |
| 2,066,183 | 12/1936 | Mehaffey . | |
| 2,111,637 | 3/1938 | Mehaffey | 116/308 |
| 2,587,147 | 2/1952 | Gulon et al. | 116/308 |
| 2,817,451 | 12/1957 | Giles et al. . | |
| 3,960,713 | 6/1976 | Carey . | |
| 4,347,804 | 9/1982 | Villa-Real . | |
| 4,501,370 | 2/1985 | Kelley . | |
| 4,729,472 | 3/1988 | Lubin et al. . | |

FOREIGN PATENT DOCUMENTS

| | | | |
|---|---|---|---|
| 347825 | 9/1904 | France | 116/308 |

*Primary Examiner*—Bryon P. Gehman
*Attorney, Agent, or Firm*—Gary M. Polumbus

[57] ABSTRACT

A device suitable as a closure cap for a medicine container is provided. The device has indicia circumferentially marked on the upper surface of the device representing the time for next taking the medicine in the container. An arm is rotatably mounted on a slightly flexible but resilient shaft inserted through the center of the device and is set to point at the time for next taking the medicine. The arm is releasably retained in position by cooperating pegs and indentations on the upper surface of the device and the underside of the rotatable arm.

16 Claims, 2 Drawing Sheets

Fig_5
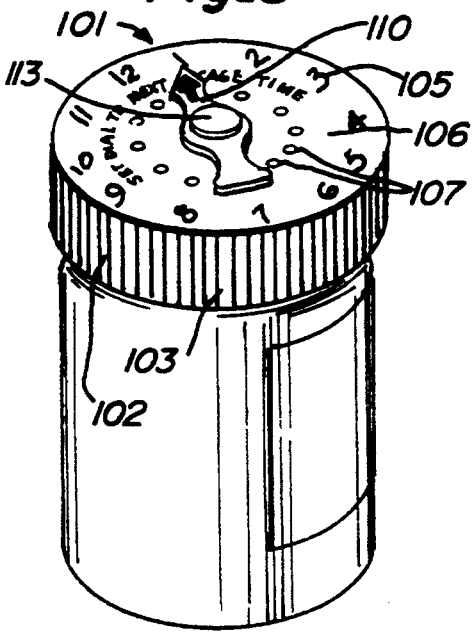
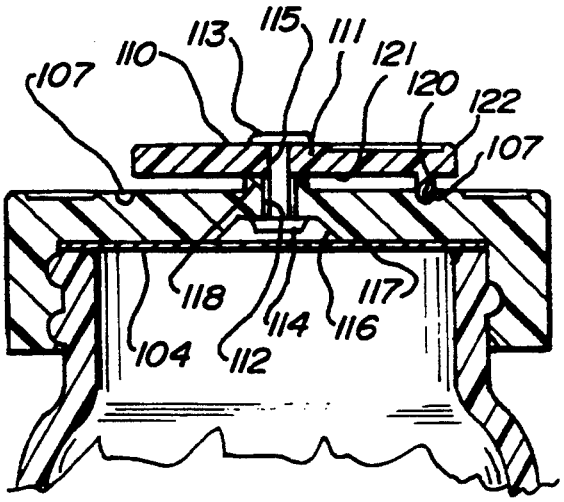
Fig_7
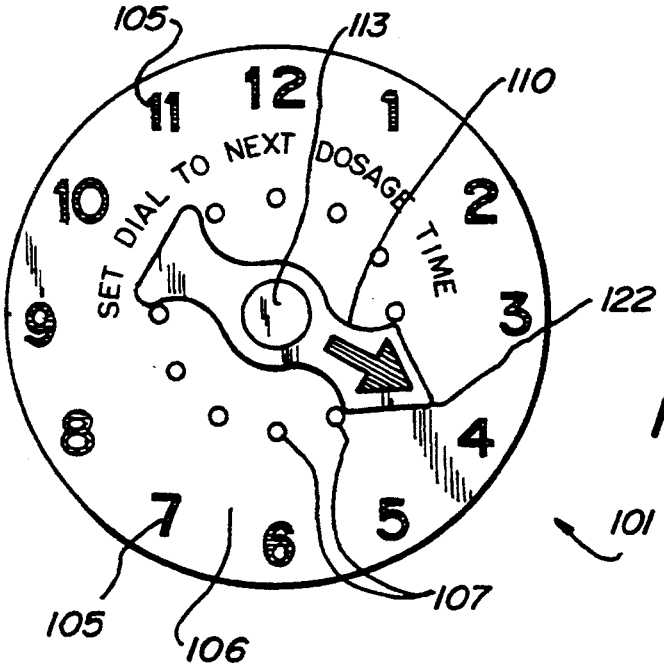
Fig_6

MEDICINE CONTAINER CAP WITH TIME INDICATOR

RELATED APPLICATION

This application is a continuation-in-part of co-pending U.S. patent application Ser. No. 07/934,956 filed Aug. 25, 1992 for "MEDICINE CONTAINER CAP WITH TIME INDICATOR", now U.S. Pat. No. 5,279,422, the disclosure of which is incorporated by reference herein.

BACKGROUND OF THE INVENTION

1. Field of the Invention

The present invention relates to a closure cap for medicine containers. More particularly the present invention relates to a closure cap having a time indicator for use with medicine containers to assure timely taking of the medications contained therein.

2. Prior Art

Pills, capsules, liquids and other medicines have long been packaged in bottles or other containers capped with a variety of closure devices. Medicine bottle caps are designed to serve multiple purposes including preventing moisture and foreign materials from entering the bottle and contaminating the medicine in the bottle. More recently, medicine caps have been designed to prevent children from gaining access to the medication.

Medicine often must be taken at particular intervals. Failure to take medicine as prescribed or directed can delay the relief afforded by the medicine and can lead to even more serious problems. For example, if the full course of certain antibiotic prescriptions are not complied with, the infection to which the antibiotic is targeted may not be curbed and the patient may develop responses to the antibiotic that can prevent full efficacy of that antibiotic in that particular patient in the future. Failure to take medicine as prescribed can also result in overdose.

The problems associated with maintaining a prescribed schedule for taking medicine are especially prevalent amongst the elderly. Often older patients must take multiple medicines each day and the time tables for different prescriptions may vary. Many older people overmedicate themselves because of confusion arising from having varying schedules for different medicines.

It is well known in the art to incorporate a time indicator device on medicine caps to avoid some of the previously described problems. Some of these prior art designs recognize the desirability of keeping manufacturing costs low due to the often disposable quality of such containers and caps. Some prior art medicine caps have time indicating numbers marked or imprinted in a circumferential manner along the upper edge of the cap, with one or two hands positioned to point to the numeral or numerals representing the hour at which the next medication is to be taken. Some inventors of prior art devices have recognized that such arrows or hands are subject to accidental rotation away from the correct hour and have attempted to avoid this problem by utilizing friction to discourage involuntary rotation.

However, the time setting mechanisms of prior art devices are not readily usable by elderly persons who may have trouble manipulating small devices with often arthritic hands. Motor control is also problematical for persons disabled through stroke or other paralysis of the upper limbs. In addition, prior art devices employing printing to indicate time can be difficult for the visually impaired to read.

OBJECTS OF THE INVENTION

It is the principal object of the present invention to provide an improved medicine container cap having a time indicator to identify the next time to take the medicine in the container.

It is another object of the present invention to provide an improved medicine container cap having a time indicator in which it is difficult to inadvertently change the time.

It is a further object of the present invention to provide an improved medicine container cap having a time indicator which may be easily set by an elderly person or a person visually impaired or otherwise disabled.

It is a still further object of the present invention to provide a medicine container cap having a time indicator with the aforementioned qualities which is rugged and inexpensive to manufacture.

SUMMARY OF THE INVENTION

The present invention relates to an improved medicine container cap having a time indicator to identify the next time to take the medicine in the container. The present invention includes a rotatable arm which is directed to point at indicia on the cap representing the time for next taking the medicine. The indicia identifying the time for next taking medication may be embossed or inscribed on the cap so that a visually impaired person may identify by feel the next time the medicine is to be taken. The rotatable arm is releasably retained by one or more cooperating pegs and indentations on the arm and on the cap in such a manner that the arm is not subject to inadvertent or accidental movement. In the present invention, the arm is both rotatable and pivotable so that the peg and indentation arrangement may be easily released and the time for next taking medication easily set.

BRIEF DESCRIPTION OF THE DRAWINGS

FIG. 5 is an isometric view of another embodiment of the medicine container cap of the present invention attached to a medicine container.

FIG. 6 is a top plan view of the medicine container cap shown in FIG. 5.

FIG. 7 is a fragmentary cross-section of the medicine container cap shown in FIG. 5, taken along the plane 7—7.

DETAILED DESCRIPTION OF THE PREFERRED EMBODIMENTS

Figure 1:
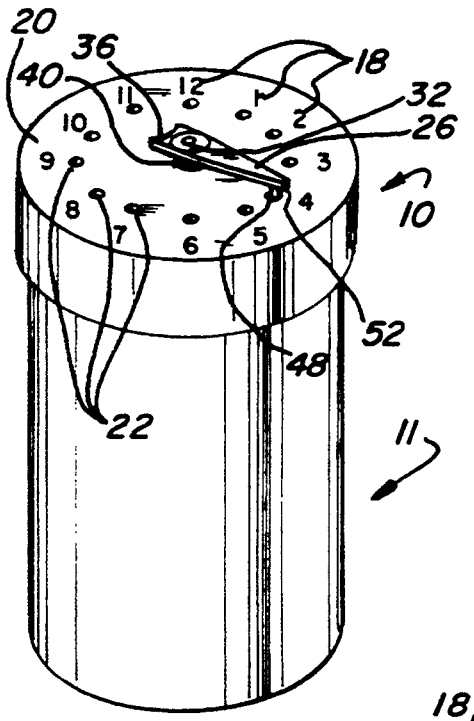
FIG. 1 is an isometric view of a first embodiment of the medicine container cap of the present invention attached to a medicine container.
Figure 2:
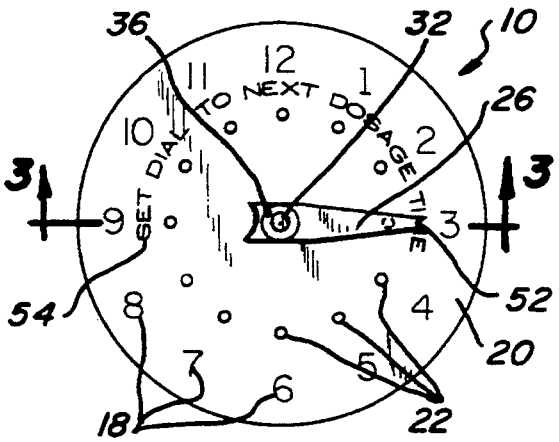
FIG. 2 is a top plan view of the medicine container cap shown in FIG. 1.
Figure 3:
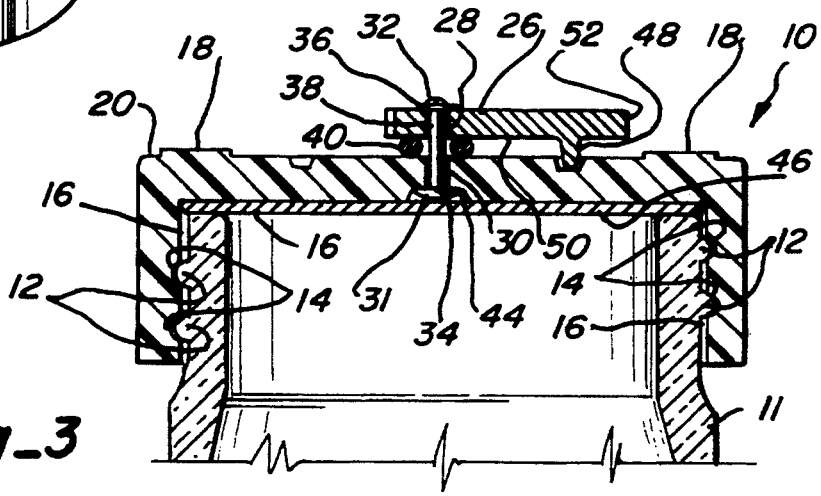
FIG. 3 is a fragmentary cross-section of the medicine container cap shown in FIG. 2, taken along the plane 3—3.

FIGS. 1, 2 and 3 illustrate a first preferred embodiment of a medicine container cap 10 which indicates the next time for taking the medicine confined in a medicine container 11. The time indicator shown in FIGS. 1, 2 and 3 may be easily manipulated by an elderly or disabled person and is designed to inhibit involuntary or accidental movement. The medicine container cap 10 shown in FIGS. 1, 2 and 3 is rugged but can be manufactured in an economical manner.

In the embodiment shown in FIGS. 1, 2 and 3, the medicine container 11 is essentially a hollow cylinder closed at the bottom end and open at the top end. The cap 10 is attached to the container 11 by a screw fastening system, which is illustrated by the helical ridges 12 of the medicine container and the complementary grooves 14 in the underside 16 of the cap 10. Other systems of securing the cap 10 to the container 11 may also be employed.

In the first preferred embodiment, the medicine cap 10 includes indicia in the form of numerals 18 representing the hours of the day circumferentially raised or embossed on the upper surface 20 the cap. By employing raised numerals 18, persons with vision problems are able to utilize the present invention by touching the numerals to determine by feel the next time for taking the medicine in the container.

Radially inwardly adjacent to each of the numerals 18 is an indentation 22 formed in the upper surface 20 of the cap 10. Each of the indentations 22 is equidistant 10 from the center of the medicine cap 10.

A substantially rigid elongated arm 26 is rotatably mounted in the center of the medicine cap 10 so that the arm can be pointed towards a numeral 18 representing the time at which the next dosage of medicine is to be taken. The arm 26 is rotatably mounted on a shaft 28 inserted through an aperture 30 formed in the center of the cap 10. The aperture 30 is slightly larger in diameter than the diameter of the shaft 28 to permit not only rotative movement of the shaft but also a slight amount of pivoting movement of the arm 26 perpendicularly relative to the upper surface 20 of the cap 10 for a purpose discussed below.

The shaft 28 is substantially hollow having a relatively large shaft boss or head 32 closing the upper end. The shaft has a second shaft boss 34 at its lower end which is preferably not integrally formed with the shaft. Instead, the shaft is internally threaded and receives a bolt type fastener in its open lower end which constitutes the second shaft boss 34 and secures the shaft to the cap. The shaft 28 is mounted by insertion of the shaft through a washer 36, an aperture 38 formed in the arm 26, a resilient o-ring 40 and the cap aperture 30. The bolt 34 is inserted into the lower end of the shaft 28 and attached thereto by a screwing motion which causes conforming grooves in the inside of the shaft and the exterior of the bolt to engagingly lock. The head of the bolt 34 has a diameter larger than the diameter of the cap aperture 30 but slightly smaller than the diameter of a concavity 44 formed in the underside 16 of the cap 10. The head of the bolt 34 fits snugly in the concavity 44 to prevent excessive wobbling of the shaft 26. The thickness of the head of the bolt 34 is slightly less than the depth of the concavity 44 to allow a disk shaped seal 46 to fit flush against the cap underside 16 and prevent the contents of the container 11 from being contaminated by entry of air, liquids or particulate matter through the cap aperture 30.

In the first preferred embodiment, the washer 36 allows relatively free rotation of the arm 26 about the shaft 28, which rotation might otherwise be inhibited by friction if the shaft head 32 was directly in contact with the arm. The resilient o-ring 40 is placed around the shaft 28 between the arm 26 and the upper cap surface 20 so as to place an upward bias on the arm yieldingly urging the arm against the washer 36 positioned on the shaft above the arm. The o-ring 40 normally retains a parallel relationship between the arm 26 and the upper surface 20 of the cap 10 but permits the arm to be pivoted slightly in a direction perpendicular to the upper surface.

A peg 48 depends from the underside 50 of the arm 26 adjacent to the outermost tip 52 of the arm. The peg 48 may be formed integrally with the arm 26 or can be separately formed and attached to the arm. The peg 48 is located on the arm 26 at a distance from the center of the cap 10 equal to the distance from the center of the cap to each of the indentations 22. By so locating the peg 48 on the arm 26, the peg may be aligned over the indentation 22 closest to the numeral 18 representing the time for next taking the medicine and the arm will then point to that numeral.

In the first preferred embodiment of the present invention, the arm 26 will cease rotating when the peg 48 is seated in an indentation 22. After insertion of the peg 48 into a particular indentation 22, the arm 26 is maintained in a substantially parallel relationship to the upper surface 20 of the cap 10 due to the bias of the o-ring 40 urging the arm against the flat washer 36. The resilience of the o-ring 40 permits the substantially rigid arm 26 to be moved into and out of the indentations 22.

When the time set for taking the medicine arrives, the cap 10 is removed from the container 11, the prescribed dosage of medicine contained therein is also removed, and the cap is replaced. The time for taking the next dosage is then set by pivoting the arm 26 perpendicularly to the upper surface 20 against the bias of the o-ring 40 to release the peg 48 from the indentation 22 in which it has previously been seated and then rotating the arm to a position where it points to the numeral 18 representing the next time at which medication is to be taken. The arm tip 52 is then released so that the peg 48 is seated in the selected indentation 22, as previously described.

An explanatory text 54 containing the legend "SET DIAL TO NEXT DOSAGE TIME" is preferably marked on the cap 10 as a reminder.

Figure 4:
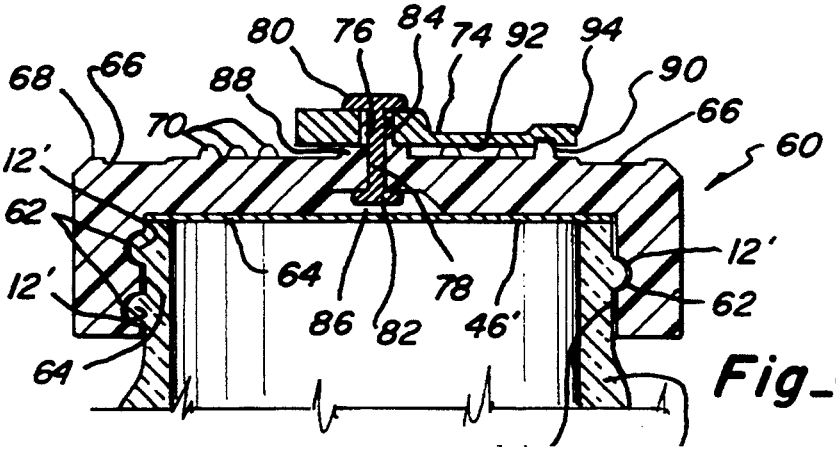
FIG. 4 is a fragmentary cross-section similar to FIG. 3 of a second embodiment of the present invention of a medicine bottle cap.

An alternative embodiment of a medicine cap 60 having a time indicator is illustrated in FIG. 4 with like parts having been given like reference numerals with a prime suffix. In the alternative embodiment, the cap 60 is attached to a container 11' by a screw fastening system, which is illustrated by the helical ridges 12' of the medicine container and the complementary grooves 62 in the underside 64 of the cap. Other systems of securing the cap 60 to the container 11' may also be employed.

In the alternative embodiment, indicia in the form of numerals 66 representing the hours of the day are circumferentially inscribed or engraved in the upper surface 68 of the cap. By employing engraved numerals 66, persons with vision problems are able to utilize the present invention by touching the numerals to determine by feel the next time for taking the medicine in the container.

Radially inwardly adjacent to each of the numerals 66 is one or more upstanding pegs 70 formed in the upper surface 68 of the cap 60. Each of the pegs 70 is equidistant from the center of the medicine cap 60. The pegs 70 of the alternative embodiment function in a manner analogous to that served by the indentions 22 of the first embodiment described above, and are further discussed below.

A slightly flexible elongated arm 74 is rotatably mounted in the center of the medicine cap 60 so that the arm can be pointed towards a numeral 66 representing the time at which the next dosage of the medicine is to be taken. The arm 74 is rotatably mounted on a shaft 76, which may be plastic or a deformable metal, inserted through an aperture 78 formed in the center of the cap 60. The aperture 78 is slightly larger in diameter than the diameter of the shaft 76 to permit rotative movement of the arm and the shaft.

The shaft 76 is retained in the aperture 78 by a first shaft boss 80 at the upper end of the shaft and a second shaft boss 82 at the lower end of the shaft. Prior to assembly of the shaft 76, arm 74 and cap 60, the first shaft boss 80 has been previously formed at the upper end of the shaft, but the second shaft boss 82 has not been so formed, and the lower end of the shaft is approximately the same diameter as the shaft. The shaft 76 is then inserted through the arm 74 and the cap 60 by insertion of the lower end of the shaft through an aperture 84 in the arm and the aperture 78 in the cap.

After insertion of the shaft 76, the second shaft boss 82 is formed on the lower end of the shaft. The formation of the second shaft boss 82 may be accomplished by melting the lower end of the shaft 76 when the shaft is composed of plastic or forcefully expanding the lower end by compressive blows as in rivoting when the shaft is deformable metal. The second shaft boss 82 is formed to have a diameter larger than the diameter of the cap aperture 78 but slightly smaller than the diameter of a concavity 86 formed in the underside 64 of the cap 60. The second shaft boss 82 fits snugly in the concavity 86 to prevent wobbling of the shaft 76. The thickness of the second boss 82 is less than the depth of the concavity 86 to allow a disk shaped seal 46' to fit flush against the cap underside 64 and prevent the contents of the container 11' from being contaminated by entry of air, liquids or particulate matter through the cap aperture 78.

In the alternative embodiment, a raised circular hub 88 is formed about the aperture 78 of the cap 60. The hub 88 supports the arm 74 so that the arm rests above the upper surface 68 of the cap 60 in a substantially parallel relationship to the upper cap surface.

The flexible elongated arm 74 contains an indentation 90 formed in the underside 92 of the arm in a position analogous to the location of the peg 48 on the arm 26 of the first preferred embodiment illustrated in FIG. 3. In the embodiment shown in FIG. 4, the arm 74 is rotated about the shaft 76 even though the shaft is also free to rotate within the cap aperture 78.

To set the indicator to the next time to take medicine in the container, the tip 94 of the arm 74 is lifted and rotated about the shaft 76 until the indentation 90 on the arm aligns with a peg 70 on the cap 60 adjacent to a numeral 66 representing the time at which the next dosage of medication is to be taken. The tip 94 of the arm 74 is then released so that the indentation 90 seats on the selected peg 70. The arm 74 will now be pointing to the time for next taking the medication.

An explanatory text containing the legend "SET DIAL TO NEXT DOSAGE TIME" is preferably marked on the cap 60 as a reminder.

In both embodiments of the present invention, the indicia representing the hours of the day are preferably from 1 through 12. In the first preferred embodiment twelve indentations are situated so that a single indentation is preferably located next to each of the twelve numerals. However, if half hour increments are desired, then 24 such indentations or pegs are formed in each medicine cap. Alternatively, if quarter hour increments are desired, then 48 such indentations or pegs are formed in each medicine cap.

Another embodiment of a medicine cap 100 having a time indicator is illustrated in FIGS. 5–7. In this embodiment the cap 100 is attached to a container 101 by a screw fastening system, which is illustrated by the helical ridges 102 of the medicine container and the complementary grooves 103 in the underside 104 of the cap. Other systems of securing the cap 100 to the container 101 may also be employed.

Indicia in the form of numerals 105 representing the hours of the day are circumferentially inscribed or engraved in the upper surface 106 of the cap, as described above in connection with medicine caps 10 and 60. Radially inwardly adjacent to each of the numerals 105 is one or more indentations 107 formed in the upper surface 106 of the cap 100. Each of the indentations 107 is equidistant from the center of the medicine cap 100.

A slightly flexible but resilient elongated arm 110 is rotatably mounted in the center of the medicine cap 100 so that the arm can be pointed towards a numeral 105 representing the time at which the next dosage of the medicine is to be taken. The arm 100 is rotatably mounted on a slightly flexible but resilient shaft 111 inserted through an aperture 112 formed in the center of the cap 100. The aperture 112 is slightly larger in diameter than the diameter of the shaft 111 to permit the shaft 111 to bend along its longitudinal axis for a reason that will become more clear hereafter.

The shaft 111 is retained in the aperture 112 by a first shaft boss 113 at the upper end of the shaft 111 and a second shaft boss 114 at the lower end of the shaft 111. Prior to assembly of the shaft 111, arm 110 and cap 100, the first shaft boss 113 has been previously formed at the upper end of the shaft, but the second shaft boss 114 has not been so formed.

The shaft 111 is inserted through an aperture 115 in the arm 110 and then through the aperture 112 in the cap 100. After insertion of the shaft 111, the second shaft boss 114 is formed on the lower end of the shaft 111. The formation of the second shaft boss 114 may be accomplished by heating and softening the lower end of the shaft 111 if the shaft is plastic. If the shaft is metal, percussive blows to the lower end of the shaft to deform same will form the second shaft boss 114.

The second shaft boss 114 is formed to have a diameter larger than the diameter of the cap aperture 112 but slightly smaller than the diameter of a concavity 116 formed in the underside 104 of the cap 100. The second shaft boss 114 fits snugly in the concavity 116 to prevent wobbling of the shaft 111. The thickness of the second boss 114 is less than or equal to the depth of the concavity 116 to allow a disk shaped seal 117 to fit flush against the cap underside 104 and prevent the contents of the container 101 from being contaminated by entry of air, liquids or particulate matter through the cap aperture 112.

Preferably, the second shaft boss 114 is fixedly mounted within the concavity 116 to further prevent wobbling of the shaft 111. In this configuration, the arm 110 rotates about the shaft 111, as described herein. Alternatively, the arm 110 may be fixedly mounted to the shaft 111, with the shaft rotatably mounted within the cap aperture 112. In this alternative configuration, the arm 110 and shaft 111 are rotated as an integral unit.

A raised circular hub 118 is formed on the top of the cap 100 about the aperture 112. The hub 118 supports the arm 110 so that the arm rests above the upper surface 106 of the cap 100 in a substantially parallel relationship to the upper cap surface 106.

A peg 120 depends from the underside 121 of the arm 110 adjacent to the outermost tip 122 of the arm. The peg 120 may be formed integrally with the arm 110 or can be separately formed and attached to the arm. The peg 120 is located on the arm 110 at a distance from the center of the cap 100 equal to the distance from the center of the cap to each of the indentations 107. By so locating the peg 120 on the arm 110, the peg 120 may be aligned over the indentation 107 closest to the numeral 105 representing the time for next taking the medicine and the arm 110 will then point to that numeral. When there are more indentions 107 than numerals 105, the additional indentions 107 indicate quarter-hour, half-hour or other incremental time periods between whole hours for next taking medication. The arm 110 of the cap 100 is releasably restrained from rotating when the peg 120 is seated in an indentation 107.

When the time set for taking the medicine arrives, the cap 100 is removed from the container 101, the prescribed dosage of medicine is removed from the container 101, and the cap 100 is replaced. The time for taking the next dosage is then set by flexing the shaft 111 along its longitudinal axis so that the flexible but resilient arm 110 is moved perpendicularly to the upper surface 106 to release the peg 120 from the indentation 107 in which it has previously been seated and then rotating the arm 110 to a position where it points to the numeral 105 representing the next time at which medication is to be taken or points between numerals 105 to indicate the next quarter-hour, half-hour or other increment of time at which medication is to be taken. The arm tip 122 is then released so that the peg 120 is seated in the selected indentation 107, as previously described. If the shaft 111 is over-flexed causing the arm 110 to engage the top of the cap 100, the flexibility of the arm prevents damage thereto.

Alternatively, and as described above in connection with FIG. 4, the arrangement of peg and indentations of the cap 100 may be reversed. In the alternative configuration, a series of pegs are circumferentially formed in the upper surface 106 of the cap 100 and a cooperating hole formed in the underside 104 of the cap 100.

Whatever cooperating means are employed to set the arm 110 to indicate the time for taking medicine, an explanatory text containing the legend "SET DIAL TO NEXT DOSAGE TIME" is preferably marked on the cap 100 as a reminder.

While certain illustrative embodiments of the present invention have been shown in the drawings and described above in considerable detail, it should be understood that there is no intention to limit the invention to the specific form disclosed. On the contrary the invention is to cover all modification alternatives, equipment and uses falling within the spirit and scope of the invention as expressed in the appended claims.

What is claimed:

1. A cap for a medicine container indicating the time at which the next dosage of the medicine is to be taken, said cap comprising:

a body having releasable fastener means for securing the cap to said container, an upper cap surface, a cap underside and a cap center;

indicia substantially circumferentially located on said upper cap surface representing time increments;

a slightly flexible and resilient shaft protruding though said body;

an elongated arm mounted on said shaft for rotatable movement in a spaced and substantially parallel relationship with said upper cap surface to point at the indicia representing the time at which the next dosage of the medicine is to be taken; and cooperating peg means and indentation means on said arm and said upper cap surface adapted to be releasably engaged to releasably retain said arm in selected orientations relative to said upper cap surface so as to cooperate with said indicia to indicate the time at which the next dosage of medicine is to be taken.

2. A cap as defined in claim 1 wherein said indicia are inscribed on said upper cap surface.

3. A cap as defined in claim 1 wherein said indicia are embossed on said upper cap surface.

4. A cap as defined in claim 1 further comprising:

a first shaft end of said shaft positioned above said arm;

a second shaft end of said shaft positioned below said cap underside; and an aperture formed in said cap center through which said shaft protrudes.

5. A cap as defined in claim 4 further comprising:

a first shaft boss formed at said first shaft end to retain said arm on said shaft; and a second shaft boss formed at said second shaft end to retain said shaft in said cap.

6. A cap as defined in claim 5 further comprising:

a concavity formed in said cap underside, said concavity being sized to receive said second boss.

7. A cap as defined in claim 6 further comprising:

a raised hub circumferentially formed about said aperture and encircling said shaft to maintain said arm in a spaced position above and substantially parallel with said upper cap surface.

8. A cap as defined in claim 7 wherein said aperture has an aperture diameter and said shaft has a shaft diameter and said shaft diameter is slightly smaller than said aperture diameter to allow said arm to pivot perpendicularly relative to said upper cap surface.

9. A cap for a medicine container indicating the time at which the next dosage of the medicine is to be taken, said cap comprising:

a body having releasable fastener means for securing the cap to said container, an upper cap surface, a cap underside and a cap center;

indicia substantially circumferentially located on said upper cap surface representing time increments;

an aperture formed in said cap center;

an elongated arm rotatably mounted on said cap to point at the indicia representing the time at which the next dosage of the medicine is to be taken;

a slightly flexible and resilient shaft onto which said arm is mounted, said shaft extending through said aperture and having a first shaft end positioned above said arm and a second shaft end positioned beneath said cap underside;

a first shaft boss formed on said first shaft end to retain said arm on said shaft;

a second shaft boss formed on said second shaft end to retain said shaft in said cap;

a plurality of circumferentially spaced indentations in said cap upper surface, each of said indentations being associated with a time increment, and a peg depending from said arm having a lower end which is releasably seatable in said indentations to releasably retain said arm in selected orientations relative to said upper cap surface so as to cooperate with said indicia to indicate the time at which the next dosage of medicine is to be taken.

10. A cap as defined in claim 9 further comprising:

a concavity formed in said cap underside sized to receive said second shaft boss.

11. A cap as defined in claim 10 further comprising:

a raised hub circumferentially formed about said aperture on said upper cap surface and encircling said shaft to maintain said arm in a spaced position above and substantially parallel with said upper cap surface.

12. A cap as defined in claim 9 wherein said indicia are embossed on said upper cap surface.

13. A cap for a medicine container indicating the time at which the next dosage of the medicine is to be taken, said cap comprising:

a body having releasable fastener means for securing the cap to said container, an upper cap surface, a cap underside and a cap center;

indicia substantially circumferentially located on said upper cap surface representing time increments;

an aperture formed in said cap center;

an elongated arm rotatably mounted on said cap to point at the indicia representing the time at which the next dosage of the medicine is to be taken, said arm having an arm underside;

a slightly flexible and resilient shaft onto which said arm is mounted, said shaft extending through said aperture and having a first shaft end positioned above said arm and a second shaft end positioned beneath said cap underside;

a first shaft boss formed on said first shaft end to retain said arm on said shaft;

a second shaft boss formed on said second shaft end to retain said shaft in said cap;

a plurality of circumferentially spaced pegs extending from said cap upper surface, each of said pegs being associated with a time increment, and an indentation formed in said arm underside which releasably retains one of said pegs to releasably retain said arm in selected orientations relative to said upper cap surface so as to cooperate with said indicia to indicate the time at which the next dosage of medicine is to be taken.

14. A cap as defined in claim 13 further comprising:

a concavity formed in said cap underside sized to receive said second shaft boss.

15. A cap as defined in claim 14 further comprising:

a raised hub circumferentially formed about said aperture on said upper cap surface and encircling said shaft to maintain said arm in a spaced position above and substantially parallel with said upper cap surface.

16. A cap as defined in claim 13 wherein said indicia are embossed on said upper cap surface.

* * * * *